US006662110B1

(12) United States Patent
Bargach et al.

(10) Patent No.: US 6,662,110 B1
(45) Date of Patent: Dec. 9, 2003

(54) DRILLING RIG CLOSED LOOP CONTROLS

(75) Inventors: Saad Bargach, London (GB); Jean-Michel Hache, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/248,369

(22) Filed: Jan. 14, 2003

(51) Int. Cl.[7] ..... G01V 3/38
(52) U.S. Cl. ..... 702/6; 702/9; 175/645
(58) Field of Search ..... 702/6, 9, 14; 367/82; 175/24, 45, 26, 48; 340/855.5

(56) References Cited

U.S. PATENT DOCUMENTS

| | | | | |
|---|---|---|---|---|
| 4,019,148 | A | 4/1977 | Shawhan | 327/554 |
| 4,254,481 | A | 3/1981 | Smither et al. | 367/82 |
| 4,507,735 | A | 3/1985 | Moorehead et al. | 702/9 |
| 4,954,998 | A | 9/1990 | Rector | 367/82 |
| 5,160,925 | A | 11/1992 | Dailey et al. | 340/853 |
| 5,220,963 | A | 6/1993 | Patton | 175/24 |
| 5,259,468 | A | 11/1993 | Warren et al. | 175/45 |
| 5,269,383 | A | 12/1993 | Forrest | 175/26 |
| 5,314,030 | A | 5/1994 | Peterson et al. | 175/26 |
| 5,332,048 | A | 7/1994 | Underwood et al. | 175/26 |
| 5,646,611 | A | 7/1997 | Dailey et al. | 340/853.6 |
| 5,812,068 | A | 9/1998 | Wisler et al. | 340/855.5 |
| 5,842,149 | A | 11/1998 | Harrell et al. | 702/9 |
| 5,857,530 | A | 1/1999 | Gronseth | 175/45 |
| 5,880,680 | A | 3/1999 | Wisehart et al. | 340/853.4 |
| 6,012,015 | A | 1/2000 | Tubel | 702/6 |
| 6,021,377 | A | 2/2000 | Dubinsky et al. | 702/9 |
| 6,023,658 | A | 2/2000 | Jeffryes | 702/16 |
| 6,088,294 | A | 7/2000 | Leggett, III et al. | 367/25 |
| 6,092,610 | A | 7/2000 | Kosmala et al. | 175/61 |
| 6,101,444 | A | 8/2000 | Stoner | 702/9 |
| 6,206,108 | B1 | 3/2001 | MacDonald et al. | 175/24 |
| 6,233,524 | B1 | 5/2001 | Harrell et al. | 702/9 |
| 6,272,434 | B1 | 8/2001 | Wisler et al. | 702/9 |
| 6,296,066 | B1 | 10/2001 | Terry et al. | 175/92 |
| 6,308,787 | B1 | 10/2001 | Alft | 175/48 |
| 6,310,559 | B1 | 10/2001 | Laborde et al. | 340/853.2 |
| 6,405,808 | B1 | 6/2002 | Edwards et al. | 175/45 |
| 6,415,878 | B1 | 7/2002 | Cargill et al. | 175/61 |
| 6,419,014 | B1 | 7/2002 | Meek et al. | 166/255.2 |
| 2002/0011358 | A1 | 1/2002 | Wassell | 175/73 |
| 2002/0088648 | A1 | 7/2002 | Krueger et al. | 175/99 |

FOREIGN PATENT DOCUMENTS

WO WO/ 99/28594 6/1999

OTHER PUBLICATIONS

*Tech Power Controls Co. Composite Catalog*, Houston Texas (2000).

*Primary Examiner*—John Barlow
*Assistant Examiner*—Victor J. Taylor
(74) *Attorney, Agent, or Firm*—Andrews & Kuruth; Tim Curington; Brigitte C. Jeffery

(57) ABSTRACT

Method, apparatus and systems for drilling wells, such as for production of petroleum products and ensuring efficient well drilling and protection of well drilling systems during drilling operations. A closed-loop drilling control system, including a digital switching control regulator (SCR) module is provided for automated actuation of selected drilling rig controls responsive to downhole and surface measurements of drilling parameters. The closed-loop drilling control system is responsive to digital data from a measuring-while-drilling (MWD) tool for refining the drilling controls by automated correction of driller inputs to the drilling controls of the well drilling system during drilling operations. The downhole data, such as surface weight on bit, downhole weight on bit, pressure and flow rate of downhole drilling fluid hydraulics, etc. is transmitted by MWD telemetry to a digitally controlled switching control regulator (SCR) module via an interfacing computer and utilized to refine the drilling controls by automated downhole data responsive correction of driller inputs to the drilling controls of the well drilling system.

25 Claims, 3 Drawing Sheets

DRILLING RIG CLOSED LOOP CONTROLS

BACKGROUND OF INVENTION

Field of the Invention

The present invention generally concerns apparatus and systems for drilling wells, such as for production of petroleum products and more specifically concerns methods and systems for ensuring efficient well drilling and protection of well drilling systems during drilling operations. More particularly, the present invention concerns a closed loop control system for drilling rig controls, which is responsive to downhole measurement by drilling tools. The measured downhole data is transmitted by measurement while drilling (MWD) telemetry to a digitally controlled switching control regulator (SCR) module via an interfacing computer and utilized to refine the drilling controls by automated correction of driller inputs to the drilling controls of the well drilling system.

For production of petroleum products, such as crude oil, natural gas and mixtures thereof from subsurface reservoirs boreholes are drilled in the earth from the surface to one or more subsurface petroleum bearing zones, typically by rotating a drill bit against the formation. The drill bit may be rotated against the formation by a rotary table or top drive of a drilling rig via multiple interconnected lengths or stands of drill stem to which the drill bit is connected. Alternatively, the drill bit may be driven by a downhole motor, typically referred to as a "mud motor" which is connected to the drill stem or to coiled tubing and which has a rotary drive shaft to which the drill bit is connected. Regardless of the character of the drilling system, the drill stem or coiled tubing defines a flow passage through which drilling fluid, typically referred to as "drilling mud," is pumped. The drilling fluid is typically a weighted slurry which, even in absence of pump pressure, develops sufficient bottom hole pressure to overcome formation pressure and prevent well blowout in the event a pressurized subsurface pocket is encountered by the drill bit.

A well drilling device, which is typically referred to as a "drilling rig," for drilling with interconnected lengths of drill stem, is provided with a controllable drill stem handling apparatus including a crown block and a traveling block each having multiple sheaves about which wire cable is laced. The traveling block is typically provided with a hook which typically has supporting engagement with the bail of a swivel apparatus which permits rotation of the drill stem or a rotary table driven kelly to which the drill stem is connected and provides a fluid inlet through which drilling fluid is pumped into the drill stem by one or more mud pumps. The wire cable is fed from a storage spool of a drilling rig drawworks to the sheaves of the crown block and traveling block and provides for supporting, controllably lowering or raising the traveling block and thus the drill stem to thus control engagement of the drill bit against the formation as the drill bit is rotated during drilling. Alternatively, where rotation of the drill stem is accomplished by a top drive system, the top drive mechanism and the swivel assembly are supported, lowered and raised by the hook of the traveling block.

Personnel accomplishing actuating control of the drilling rig is typically an experienced person known as the "driller". During most phases of rig operation the driller is stationed at a control console which is equipped with a display or multiple displays identifying the various important parameters of the well drilling operation. The wire cable storage spool of the drawworks typically incorporates a brake which is controlled by the driller or by a software program commanded by the driller, permitting controlled payout of wire cable from the spool and thus permitting controlled weight actuated descent of the traveling block and drill stem for controlled penetration of the drill bit into the formation.

As the true objective of rig controls is to achieve a particular set of drilling parameters downhole and at the bit, if the actual measurements of the downhole drilling parameters are not available, one has to compute their values from the surface measurements only. A typical case is to compute the Downhole Weight On Bit (DWOB) from the total weight suspended to the Derrick (Hook load), by subtracting the weight of the pipes, which are suspended in Tension (Wt). This calculated weight on bit is commonly called Surface Weight On Bit (SWOB). Hookload and SWOB are basically related by the following equation:

$$\text{SWOB}=\text{Hookload}-(\text{Wt}) \tag{1}$$

The difference is equal to the sum of all the pipes or drill collars, which are below the neutral point of tension/compression (usually the drill collars).

Immediately, some complications become apparent, which can be alleviated by downhole measurements:

Effect of Inclination:The pipes, which are not in tension only, contribute to DWOB through the component of their weight, which is aligned with the borehole, not by their absolute weight. Hence a first complication of the equation:

$$\text{SWOB}=\text{Hookload}(\text{Wt})\times\text{Cosines}(\text{Inclination}) \tag{2}$$

Effect of Flotation in Drilling Mud:

The drill string is immersed in the drilling mud, which has a significant density (pMud), resulting in a flotation force proportional to the weight of fluid displaced by the immerged part of the drill string. Hence a second complication of the equation, with Vstring of the immerged part of the drill string $$\text{SWOB}=(\text{Hookload}(\text{Wt})\times\text{Cosines}(\text{Inclination}))\text{pMud}\times V\text{string} \tag{3}$$

This being a first approximation, given to illustrate the actual complexity of the problem, as the floatation force is vertical, and the drill string may be inclined on a significant part of its length, requiring the knowledge of the well profile (Inclination versus depth) for exact calculation.

The Third Effect is Friction of the Drill String against the Borehole (F):

The friction force is opposed to the direction of the displacement. As the driller can move the drill string up and down when the bit is off-bottom, it is possible to have a surface measurement of the friction forces:

$$Fric=\tfrac{1}{2}(\text{Hookload going up Hookload going down}) \tag{4}$$

This reduces the actual weight on bit, and can be accounted for in the calculation of SWOB:

$$\text{SWOB}=(\text{Hookload}(\text{Wt})\times\text{Cosines}(\text{Inclination}))\text{pMud}\times V\text{string Fric} \tag{5}$$

As drilling of a well progresses, the friction forces can change for several reasons:

inclination changes, coefficient of friction changing as new formations are cut or as the borehole degrades, packing of debris around the drill string, friction of stabilizers increasing when the hole size decreases as the drill bit wears down or when the borehole collapses. The only way to actualize Fric, if no downhole measurements are available, is to stop drilling and repeat the up and down motion to obtain a new value of the difference. Since this activity results in interruption of the drilling process, it is not done frequently. Whereas, the Hook load is constantly adjusted manually by the driller when drilling a 90 ft stand, generally, the up and down motions only occur when connecting a new 90 ft stand. The estimation of Friction is therefore established at each connection, however, thereafter assumed constant when drilling the next 90 ft section.

One can readily identify a number of scenarios where a driller's manual control input based on experience will fail to accomplish the desired result:

Scenario 1: Stabilizer Hanging Up

If one stabilizer of the drill string is hanging up, the weight of the drill string is not transmitted to the drill bit, and lowering the block (traveling block hook supporting the drill string) to achieve a constant rate of penetration (ROP) will not have the desired effect. In reality, it can cause damage to the drill string by buckling and other consequences of overload.

Scenario 2: Sudden Reduction in Formation Strength Due to Pressure Imbalance Between Mud and Formation, or Properties of Rock Geomechanics If the driller maintains the same SWOB command setting, the ROP will suddenly increase at a time where it may be critical to slow down and analyze the situation.

When using an automatic drilling control process strictly based on surface information, similar limitations affect the computer model. In the absence of downhole data, it assumes that the relation between SWOB and DWOB is constant for a certain length of time. Consequently, the automation has been limited to simpler applications such as maximum and minimum block height, or maximum block speed.

SUMMARY OF INVENTION

It is a principal feature of the present invention to accomplish automated control of the downhole weight on bit while drilling, as well as controlling other well drilling functions such as downhole and surface torque control, downhole pressure control and MWD automatic frequency selection in response to downhole data.

It is another feature of the present invention to provide for downhole measurement responsive closed-loop control of various well drilling functions, by acquiring selected downhole parameter measurements by means of an MWD tool component of a drill string, transmitting the digital data output of the MWD tool to the surface via MWD telemetry and inputting the digital data to the rig controls computer as it becomes available via telemetry for updating the mathematical model of the drilling control system response.

It is another feature of the present invention to update the mathematical model of the drilling control system at frequent intervals during drilling, with data representative of measured downhole drilling parameters that are sensed during drilling.

It is an even further feature of the present invention to accomplish well drilling using a drill string having a top drive or downhole drilling motor being controlled by a drawworks that is controlled by a mathematical model programmed into a drilling control system and with the mathematical model being updated or calibrated frequently with substantially real time downhole data representing drilling parameters at or near the drill bit, so that automated optimized drilling is accomplished.

Whereas downhole measurements transmitted by MWD tools are known in the drilling industry, in the past data representing downhole measurements have only been used to provide a human operator (the driller) with additional information indicating downhole conditions, thereby permitting the driller to manually adjust the rig controls more in response to actual downhole conditions rather than relying on interpretation of downhole conditions from surface measurements.

The recent deployment of digitally controlled SCR modules offers the possibility to refine the rig controls by supplementing the driller with automatic corrections to minimize classical control problems such as overshooting the desired control level, oscillations around the desired control level, late response, out of phase response, or erroneous control input. Currently, digital SCR modules use surface measurements in computer models to achieve automatic corrections to manual or driller commands by correcting or optimizing the driller inputs to the rig controls. However, because that is done without direct knowledge of downhole conditions, the automation has been limited, thus, still depending on operator skills.

According to the principles of the present invention, by digitally connecting the relevant downhole measurements to the computer of a digital SCR module or other automated drilling system, the drilling system software model can be calibrated with actual downhole data. Measurement data reflecting surface conditions and measurement data reflecting downhole conditions during drilling are compared by the mathematical drilling control model of the digital SCR module and used to update the system software model with comparative surface/downhole data or with the downhole data. The calibrated software thus recognizes manual control commands that are optimized by measured downhole conditions. When this condition occurs, the drilling control software causes the manually input commands to be overridden or optimized, thus permitting drilling to continue in response to actually measured downhole conditions.

To achieve the next step in automation in controlling the weight on bit while drilling and the rate of penetration, the proposed invention uses all relevant downhole information to update the rig controls computer model as frequently as they become available through the MWD telemetry. In the past the rig controls computer model has been updated at the time another 90-ft section of drill pipe is connected to the drill string, for example at each 90-minute interval, when drilling is progressing at the rate of 90 ft per hour. The present invention permits the software to be updated or calibrated once each minute or so d drilling, and without necessitating interruption of the drilling operation to accomplish calibration.

The downhole measurements are processed by the computer interface/transfer function of the MWD surface acquisition system and are output in digital form. The digital downhole measurement data is then sent to the digital SCR module as shown in FIG. 1. The transfer function that is used in the control module software is updated by comparing data representing downhole measurements and data representing surface measurements. For example, the traveling block height is no longer servoed from SWOB, block speed, and stand pipe pressure (all surface measurements) but can also use, as non-limitative example, DWOB, downhole internal pipe pressure, and annulus mud pressure (all available from current MWD tools).

The update rate required from the MWD telemetry is not necessarily faster than current capability, as the updates are primarily used to update the mathematical model-of the system response (the transfer function), not to directly change the rig control settings. Therefore, even one update per minute is a significant improvement over the current one update per 90 ft stand connection (typically one hour when drilling at 90 ft/hr). The MWD telemetry link is bidirectional, thus permitting operational commands to be transmitted downhole to the MWD tool and to any associated downhole equipment.

BRIEF DESCRIPTION OF DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a block diagram schematic illustration of a closed loop drilling control system shown in association with well drilling equipment and embodying the principles of the present invention and being responsive to downhole signals of a measuring while drilling tool for automated correction of the manual control of a draw works of a drilling rig;

Figure 1:
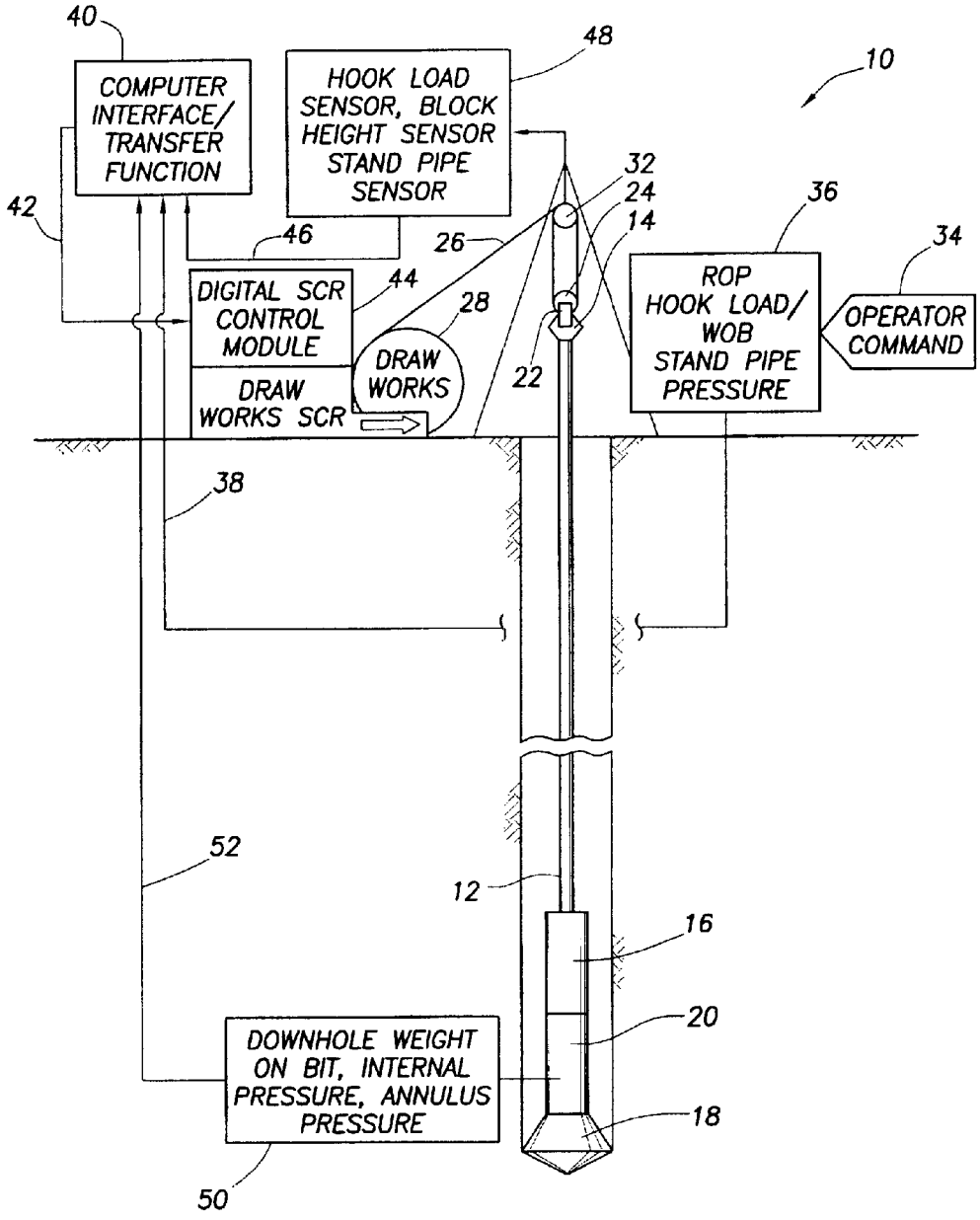
Figure 2:
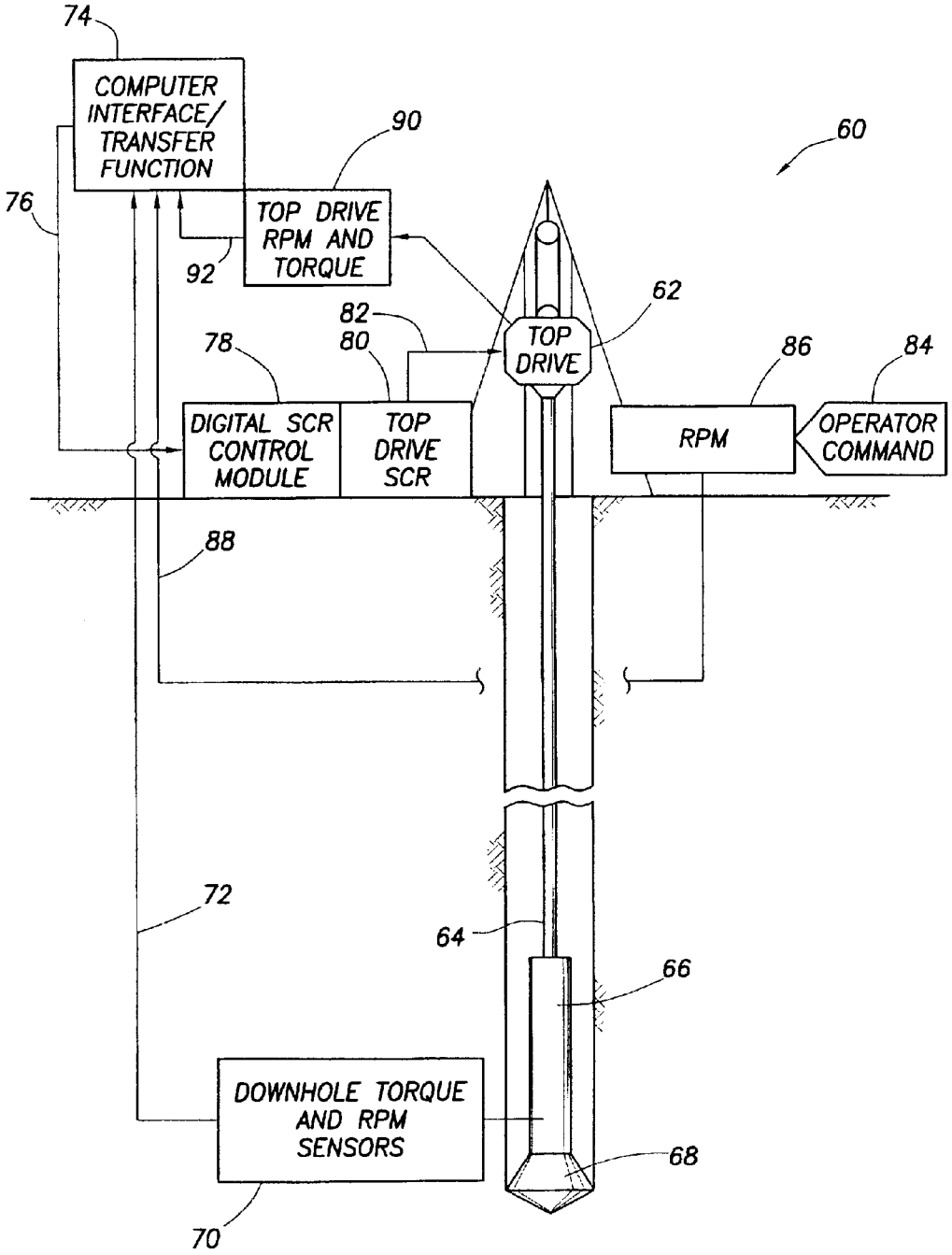
Figure 3:
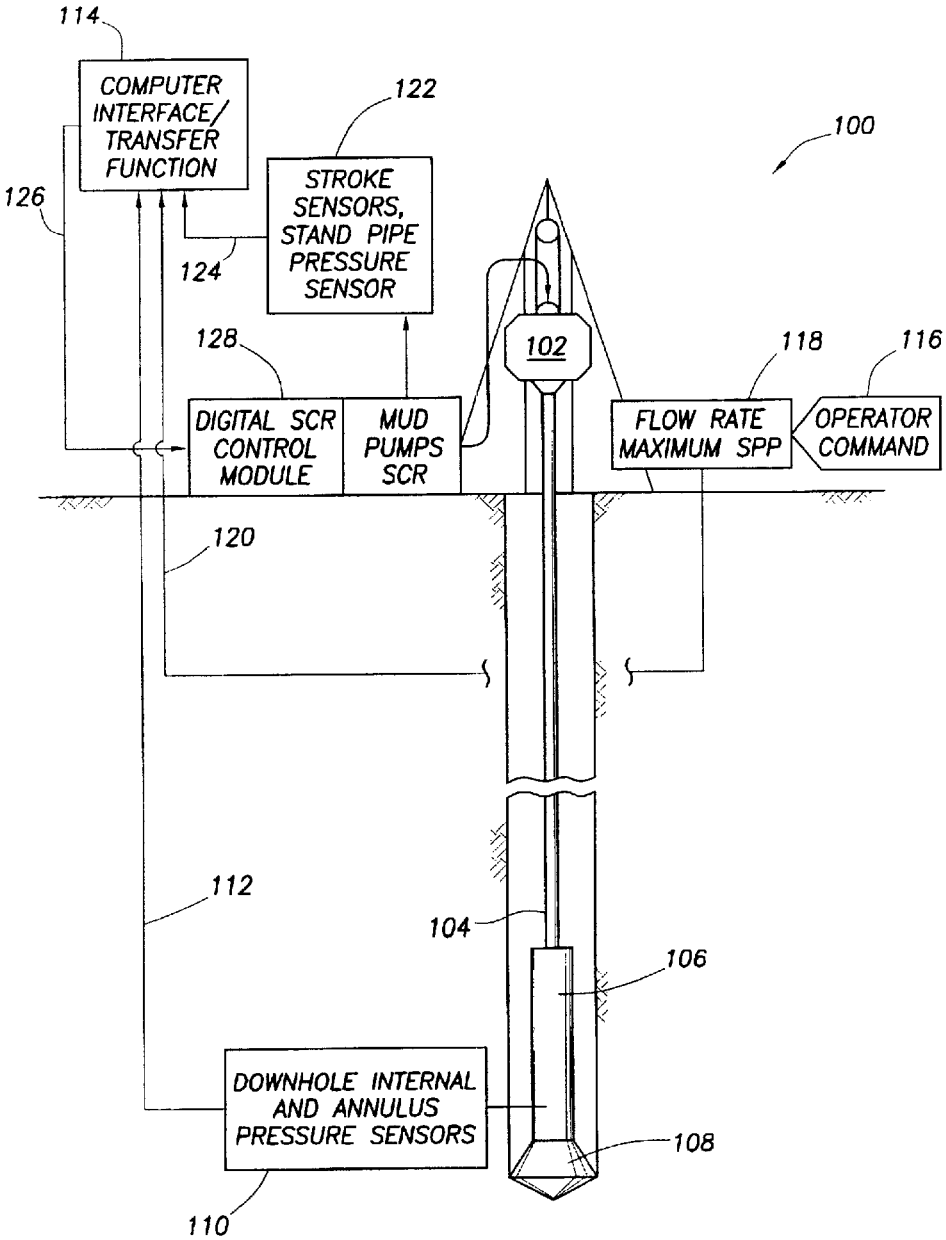

FIG. 2 is a block diagram schematic illustration of a closed loop drilling control system similar to that shown in FIG. 1 and showing signals being transmitted from the torque and RPM sensors of a measuring while drilling tool during drilling and being communicated by telemetry to a computer interface, where the signals, in digital form, are transmitted to a digitally controlled switching control regulator module for automated correction of the manually selected control of the top drive mechanism of the well drilling rig; and FIG. 3 is a block diagram schematic illustration of a closed loop drilling control system similar to that shown in FIGS. 1 and 2 and showing signals being transmitted from the internal pressure and annulus pressure sensors of a measuring while drilling tool and being communicated by telemetry to a computer interface, where resulting processed pump control signals, in digital form, are transmitted to a mud pump switching control regulator module for coordinated mud pump control.

DETAILED DESCRIPTION

Referring now to the drawings and first to FIG. 1, a well drilling system embodying the principles of the present invention is shown schematically generally at 10 and incorporates a drill string 12 which is rotated such as by the rotary table of a drilling rig. At the upper end of the drill string 12 is located a drilling swivel mechanism 14 through which drilling fluid, also called drilling mud is pumped by mud pumps of the well drilling system. As an alternative to rotation of the drill string, a mud motor 16, also shown in FIG. 1, may be provided at the lower end of a non-rotatable drill string, which is moved substantially linearly as drilling is accomplished by the rotary power of the mud motor. Regardless whether the drill string is rotated or a mud motor is utilized for drilling, a drill bit 18 is connected to the drill string or mud motor and is rotated for drilling of the well bore, simultaneously with downward or forward movement of the drill string under the control of the drawworks of the drilling rig, as explained below.

In accordance with the present invention an MWD tool 20 is connected into the drill string near the drill bit and senses a number of drilling parameters at or near the bottom of the wellbore being drilled. These sensed drilling parameters include the downhole weight on bit (DWOB), internal drilling fluid pressure within the MWD tool and (drilling fluid pressure within the annulus between the MWD tool and the wall of the wellbore. The present invention is not intended to be limited to the sensing and use of these particular measured downhole well drilling parameters; thus any downhole drilling parameters that may be sensed by a MWD tool and transmitted via the drilling fluid column by MWD telemetry may be employed without departing from the spirit and scope of the present invention. During well drilling, especially when drilling deep wells, the drill pipe often becomes twisted throughout its length by the torque force being applied to the drill string and the resistance to rotation that occurs throughout the wellbore and by rotation of the drill bit against the formation being drilled. When drill string rotation is ceased, for any of a number of reasons, the twisted drill string will unwind, often rapidly so. By controlling application of torque to the drill string, especially when rotation of the drill string is being stopped, excessively rapid unwinding or uncoiling of the drill string can be controlled.

The drill string 12 and the drilling swivel 14 are raised and lowered by the hook 22 of a traveling block 24 having multiple wire cable or cable sheaves receiving loops of wire cable having the standing end 26 thereof being paid out from the wire cable storage drum 28 of a drawworks 30. The wire cable is also wound about the multiple sheaves of an upper or crown block 32, thus providing the mechanical advantage that is necessary for controlling upward and downward movement of the drill string during the drilling process. Historically, the drawworks drum 28 has been controlled for downward movement of the drill string by the braking system of the drawworks. More recently, movement of drawworks drums have been controlled by the motors of the drawworks system, thus providing an efficient system for computerized automated control or computerized optimization of manual control of drilling operations by a driller.

The derrick hook load, from the simplistic point of view, is the weight of the top drive, drill stem and other drilling components that could contribute to the weight being applied to the drill bit. However, hook load is also influenced by the floatation force that results when the drill pipe is immersed in drilling mud, which differs in density, depending upon the characteristics of the well being drilled, the gas pressure that is expected at any given depth and the character of the formation being drilled. The block height being sensed is the height of the traveling block above a reference, such as the rig floor. The standpipe pressure is the pressure of the drilling fluid at a certain point within the flow passage to the drill stem, i.e., the drilling swivel.

Driller command is manually input as shown schematically at 34, for controlling the rate of drillbit penetration (ROP), for controlling hook load/weight on bit (WOB). Separately, the mud pumps are manually controlled by driller commands for thus controlling standpipe pressure as shown schematically at 36. The driller commands are fed via a conductor 38 or other computer link to a computer interface/transfer function 40 and after suitable processing are communicated via a conductor or computer link 42 to a digital SCR module 44. The digital SCR module 44 controls the drawworks responsive to programmed parameters thereof and responsive to data input reflecting various parameters of the well drilling system.

As mentioned above, the computer interface/transfer function 40 is provided via conductor 46 with sensor communicated "surface data" such as hook load, block height and stand pipe pressure as indicated schematically at 48. Though this surface data has been acquired by a plurality of sensors which measure "hook load", "block height" and "stand pipe pressure" of the drilling system, the surface data alone is deemed insufficient to clearly indicate the downhole conditions that are occurring at any point in time near the drill bit. The driller will often consider surface measurements and interpolate downhole conditions. At times, however, the decisions of the driller are in error, because actual downhole conditions are not evident; also, at times driller decisions responsive to surface measurements are sufficiently slow or out of phase that damage or excessive wear of drilling equipment can occur. Thus, it is considered desirable to acquire data representative of selected downhole parameters of the well drilling process and to utilize such data in as near real time as possible and in the manner of a closed loop system for optimizing the drilling process in a manner accommodating downhole conditions.

The measurements being acquired at 48 are then transmitted by a suitable conductor 46 to a computer interface/transfer function system 40 which, after processing the data, transfers the data via a suitable conductor 42 to a digital switching control regulator, (SCR) 44, which is an integrated component of a drilling control module that is commanded by the driller. Digitally controlled switching control regulator modules have been utilized in the past and provide for refinement of the drilling rig controls by supplementing the driller commands with automatic corrections to minimize classical control problems such as overshooting the desired control level, oscillations around the desired control level, late response, out of phase response, or erroneous control input. As mentioned above Digital SCR modules are commercially available at the present time, but thus far have been arranged to utilize surface measurements in computer models to achieve automatic corrections and optimization of the driller inputs to the rig controls. However, because this is done without direct knowledge of downhole conditions, the automation has been limited, and at the present time continues to be depending largely on the skills of the driller.

According to the principles of the present invention, the drilling control of the well drilling system is provided with a closed loop automated drilling control system being designed for conventional manual control and for downhole signal responsive automated correction as needed for optimized drill bit penetration and for minimizing wear and stress of downhole drilling components, such as the drill stem, measuring while drilling tool, mud motor, when utilized, and drill bit. Efficient and optimized drilling, in direct response to downhole conditions also minimizes stress to the drill string, thus ensuring the longevity of the drill pipe and other drilling components As shown schematically at 50 data representative of "downhole weight on bit", "internal pressure" of the drilling fluid within the fluid flow passage of the MWD tool and the "annulus pressure" of the drilling fluid in the annulus or space between the MWD tool and the wall of the wellbore being drilled is output by the MWD tool 20. This data is conducted by a telemetry link 52 of the MWD tool via the drilling fluid column of the wellbore to the surface, where it is input to a MWD surface acquisition system of the computer interface/transfer function 40. The data signal output of the computer interface/transfer function is in digital form and is communicated via the conductor or data link 42 to the digital SCR module 44. In the case of the embodiment of FIG. 1, the downhole data being fed to the digital SCR module is used to provide optimizing or corrective updating of the mathematical model of the software of the digital SCR module and is not utilized for direct control of the drawworks of the drilling rig, or other rig components. Also, the software update rate is not necessarily more rapid than is currently experienced because the software updates are primarily used to update the mathematical model of the system response (the transfer function), not to directly change the rig control settings. Therefore, even one update per minute is a significant improvement over the current one update per 90 ft stand connection (typically one hour when drilling at 90 ft per hour).

The transfer function that is used in the control module software is updated by comparing downhole measurements and surface measurements. For example, the traveling block height is no longer servoed from SWOB, block speed, and stand pipe pressure (all surface measurements) but can also use, as non-limitative example, DWOB, downhole internal pipe pressure and annulus mud pressure (all available from current MWD tools). Thus, under circumstances where downhole measurements provide data which allow an optimization of the command inputs of the driller, the digital SCR module will provide overriding or corrective inputs as necessary to maintain downhole drilling conditions within an optimum range.

The automated control of DWOB, for example, does not rely on a calculated SWOB where Inclination, Mud weight, Friction are calibrated from the last connection time, but on the continuously updated value CSWOB determined from:

$$\mathrm{CSWOB}(n+1)=(\mathrm{Hookload}(n+1)(\mathrm{Wt})\times\mathrm{Cosines}(\mathrm{Cont.Inc.}(n+1)))$$

$$C.\ \mathrm{pMud}(n+1)\times V\mathrm{String}-(\mathrm{CSWOB}(n)-\mathrm{DWOB}(n+1)) \quad (6)$$

Where Cont.Inc. (n+1) is the current MWD update on downhole inclination; C. pMud (n+1)×VString is the current MWD update of the floatation force based on downhole pressure measurements; CSWOB (n) is the previous value of the Continuously updated Surface Weight On Bit; and DWOB (n+1) is the current MWD update of the Downhole Weight On Bit measurement.

As opposed to the following equation:

$$\mathrm{SWOB}=(\mathrm{Hookload}(\mathrm{Wt})\times\mathrm{Cosines}(\mathrm{Inclination}))-\mathrm{pMud}\times V\mathrm{String}\ \mathrm{Fric} \quad (7)$$

where Inclination was updated every 90 ft, pMud was based on surface measurement of mud weight, ignoring dynamic pressure effects and cuttings transport effects on the floatation force, and Frictions were based on the last 90-ft connection measurements.

Referring now to FIG. 2, there is provided a schematic illustration of a closed loop downhole data responsive torque and RPM control system for a well drilling system. In this case, a well drilling system, shown generally at 60, is provided with a top drive type rotary drilling mechanism 62 for imparting rotary motion to a drill string 64. A MWD tool 66 is provided at the lower or forward end of the drill string 64 and supports a drill bit 68 which is rotated against the formation for drilling of the wellbore. The MWD tool 66 includes, among other bottom hole condition sensors, downhole torque and RPM sensors as shown at 70. By MWD telemetry 72, signal data of the downhole torque and RPM sensors is communicated to a computer interface/transfer function 74 which may be identical with the computer interface/transfer function 40 of the embodiment of FIG. 1. The processed downhole data of the computer interface/transfer function 74, being of digital form, is communicated via a computer conductor or link 76 to a digital SCR module 78 and to a top drive SCR 80 which is coupled with the digital SCR module 78. The control output of the top drive SCR 80 is communicated to the top drive control via a control conductor or link 82.

For purposes of automated data comparison, driller commands 84 will establish a desired RPM for drilling as shown at 86. The RPM data established by driller commands is communicated via a conductor or link 88 with the computer interface/transfer function 74. Measurement sensors of the top drive mechanism 62 provide a surface measurement of RPM and torque, with the measurement signals being conducted to the computer interface/transfer function 74 via a conductor or communications link 92. This feature enables the computer interface/transfer function system 74 with the capability of comparing both downhole and surface measurements of RPM and torque and to thus provide control update data via the conductor or link 76 to the mathematical model of the digital SCR module. Here again, the downhole measurements of RPM and torque are not utilized directly for overriding driller commands, but are used to update the mathematical model of the digital SCR module. The digital SCR module will then accomplish appropriate adjustments of the top drive mechanism for maintaining downhole RPM and torque within an optimum range.

With respect to the embodiment of FIG. 2, it is to be understood that downhole torque and RPM measurement data is not intended as the only data that is communicated to the computer interface/transfer function 74, but, for purpose of simplicity, is shown to emphasize the closed-loop aspects of the drilling control system of the present invention. Other downhole measurements of the MWD tool may also be utilized in like fashion for updating the mathematical model of the control module and thus providing for optimization of downhole drilling functions responsive to actually measured downhole data being receive from a MWD tool during drilling of a well.

Referring now to the schematic illustration of FIG. 3, the closed-loop control system of the present invention is also applicable for optimizing the control of the drilling fluid hydraulics during drilling of a well and responsive to measured hydraulics conditions downhole. In the embodiment of FIG. 3 a well drilling system incorporating a top drive rotary drilling mechanism is shown, but it is not intended that the spirit and scope of the present invention be restricted solely to drilling fluid hydraulics control when top drive mechanisms are employed. In the well drilling system of FIG. 3, a drilling system is shown generally at 100 having a top drive rotary drilling mechanism 102 for rotating a drill stem 104 having a MWD tool 106 and drill bit 108 connected thereto. From the standpoint of drilling fluid hydraulics, sensors of the MWD tool 106 accomplish measurement of the drilling fluid pressure within the flow passage to the drill bit and also accomplish measurement of the drilling fluid pressure within the annulus between the MWD tool and the wall of the wellbore as shown at 110. This data is conducted via MWD telemetry 112 to the surface, where it is input to a computer interface/transfer function 114.

The driller in charge of the well drilling system provides hydraulics control commands 116 for establishing a desired drilling fluid flow rate and maximum surface pump pressure as shown at 118. This surface data of flow rate and pump pressure is conducted by a data link or conductor 120 to the computer interface/transfer function 114 to enable its comparison with actually measured downhole drilling fluid hydraulic data.

The mud pump system of the drilling rig 100 provides surface measurements of pump stroke and stand pipe pressure as shown at 122, with the surface measured pump data being conducted to the computer interface/transfer function 114 via a conductor or data link 124. The computer interface/transfer function 114 thus processes the surface measurements of conductors or data links 120 and 124 for comparison with the downhole drilling fluid hydraulic data being received from the MWD telemetry link 112. The resulting digital control data is then conducted via conductor or data link 126 to the digital SCR module 128 where it is used to update the mathematical model of the software of the control module. The updated software then provides for automated changes to the mud pump settings that have been established by driller command, as necessary for providing or maintaining internal and external pressures and the bottom hole flow rate of the drilling fluid within a predetermined range for achieving optimum rate of drill bit penetration, for optimum removal of drill cuttings and for maintaining the drill bit within a desired range of temperature.

The closed-loop drilling control system of the present invention may be accomplished by utilizing any of the control functions that are identified in FIGS. 1–3 in any suitable combination that meets the requirements of any particular drilling system. Thus, the above explanations related to FIGS. 1–3 should be considered in conjunction with one another rather that being merely considered independently. From the standpoint of the present invention, regardless of the form of any particular well drilling system, it is desirable to communicate to a digital SCR module measured downhole data which is acquired during drilling and to correlate the downhole data with surface measured data and to use the correlated data to update or optimize the mathematical model of the software of the digital SCR module. The optimized control module software then provides automated control signals to the various control functions of a drilling rig system to correct or augment driller inputs to the drilling control system.

The benefits of the present invention are much the same as those obtained in other industrial automation of human controls, such as airplane auto-pilot, anti-lock brakes, etc. where matching the response speed and amplitude, with a complex system (non linear response, time dependent transfer function, etc.) is essential to improve the system performance.

From the standpoint of the well drilling industry, drilling systems utilizing the present invention will be capable of attaining higher ROP by maintaining the maximum allowable DWOB at all times, instead of exceeding the optimum rate of penetration, thus stalling the drilling motor, then lifting the drill bit from the formation to permit rotation of the drilling motor at its proper speed and then again contacting the bottom of the wellbore with the drilling bit to resume drilling. This character of intermittent or cyclic well drilling is detrimental to the components of the well drilling rig, because drilling must be stopped and started and the drill string must be raised and lowered. A greater rate of drill bit penetration is achieved and less wear and tear is caused when drilling is substantially constant. Also, the bit life of the drill bit is prolonged when it is maintained within an optimum DWOB and is enabled to be rotated substantially constantly without encountering overloads. During conventional drilling, a condition known as "stick-and-slip" often occurs, where the RPM of the bit is not constant, but is slowed due to sticking, causing twisting of the drill pipe and rotates fast for a moment when it slips from its sticking condition and the twist of the drill pipe is released. This stick-and-slip condition causes unnecessary wear to the drill pipe and also causes excessive wear and diminished service life of the drill bit. Drilling performance is significantly enhanced by the present invention because of the torque serving characteristics of the closed-loop drilling control that is discussed above.

The service life of mud motors is materially enhanced because the automated downhole measurement responsive closed-loop drilling system minimizes application of excessive drill string loads to the motor and thus avoids motor stalls and minimizes the potential for stick-and-slip of the drill bit with respect to the formation being drilled. The closed-loop drilling system permits the output shaft of mud motors to rotate at a substantially constant speed for better rate of penetration of the drill bit into the formation.

The use of coring tools has always presented a significant problem for well drilling operations, primarily because the downhole weight on bit is not known by the driller, but rather is interpolated from surface measurements. The closed-loop drilling system permits the downhole forces to which a coring tool is subjected to be substantially constantly available to the driller. Moreover, the control software of the digital SCR module is updated with data from actual downhole measurements, thus permitting precise DWOB control to be automatically maintained, even under circumstances when the control commands of the driller might be out of phase with respect to actual downhole conditions. The result of the closed-loop system of the present invention is improved coring capability and minimized wear and damage to a coring tool.

Since the closed-loop drilling system permits the drilling fluid hydraulics of the well drilling system to maintain desired flow rate, interior pressure and annulus pressure downhole, finer control of downhole pressure can be accomplished, thus preserving borehole stability in tighter fracture gradient margins.

The closed-loop drilling system permits improved process safety by accomplishing full time observance of pre-set operating limits. Also, the system accomplishes significant reduction of non-productive drilling rig time by avoidance of operator error. The close-loop drilling rig control system recognizes operator error and automatically overrides the erroneous command, thus permitting efficient drilling to be substantially continuous, when, under current circumstances, it would be necessary to stop the drilling process and enter a manual correction before continuation of the drilling process can occur.

In view of the foregoing it is evident that the present invention is one well adapted to attain all of the objects and features hereinabove set forth, together with other objects and features which are inherent in the apparatus disclosed herein.

The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein. As will be readily apparent to those skilled in the art, the present invention may easily be produced in other specific forms without departing from its spirit or essential characteristics.

We claim:

1. A method for drilling a wellbore, comprising:

advancing a drill string into the ground via a drilling rig according to manual drilling control input, the drill string having downhole sensors and a drill bit, the rig having surface sensors, a drilling control system operatively connected to the drill string;

acquiring surface measurement data representative of surface drilling parameters via the surface sensors;

acquiring downhole measurement data representative of downhole drilling parameters via the downhole sensors;

determining an optimized drilling control model by using the drilling control system to electronically compare the surface measurement data and the downhole measurement data; and adjusting the drilling control input based on the drilling control model.

2. The method of claim 1 wherein the surface measurement data comprises one of book load, block height, stand pipe pressure, torque, rpm, stroke, flow rate and combinations thereof.

3. The method of claim 1, wherein the downhole measurement data comprises one of weight on bit, internal pressure, annulus pressure, torque, rpm and combinations thereof.

4. The method of claim 1, wherein the drilling control system comprises one of a computer interface/transfer function, a digital switching control regulator and combinations thereof.

5. The method of claim 4, further comprising:

converting the downhole measurement data to digital downhole measurement data via the computer interface/transfer function; and inputting the digital downhole measurement data to the switching control regulator.

6. The method of claim 4, further comprising;

transmitting measurement data from the sensors to the computer interface/transfer function via a telemetry system;

generating a measurement data output from the computer interface/transfer function; and conducting the measurement data output from the computer interface/transfer function to the digital switching control regulator.

7. The method of claim 1 wherein the drilling control input comprises one of rate of drill bit penetration, stand pipe pressure, and combinations thereof.

8. The method of claim 1 wherein the drilling control input comprises rpm.

9. The method of claim 1 wherein the drilling control input comprises fluid flow rate, surface pump pressure and combinations thereof.

10. The method of claim 1 wherein the step of adjusting is automatic.

11. A method for drilling a wellbore, comprising:

advancing a drill string into the ground via a drilling rig according to manual drilling control input, the drill string having downhole sensors and a drill bit, a drilling control system operatively connected to the drill string;

acquiring downhole measurement data representative of downhole drilling parameters via the downhole sensors;

determining an optimized drilling control model by using the drilling control system to process the downhole measurement data; and adjusting the drilling control input based on the drilling control model.

12. The method of claim 11, wherein the downhole measurement data comprises one of weight on bit, internal pressure, annulus pressure, torque, rpm and combinations thereof.

13. The method of claim 11, wherein the drilling control system comprises one of a computer interface/transfer function, a digital switching control regulator and combinations thereof.

14. The method of claim 13, further comprising:

converting the downhole measurement data to digital downhole measurement data via the computer interface/transfer function; and inputting the digital downhole measurement data to the switching control regulator.

15. The method of claim 13, further comprising;

transmitting measurement data to the computer interface/transfer function via a telemetry system;

generating a measurement data output from the computer interface/transfer function; and conducting the measurement data output from the computer interface/transfer function to the digital switching control regulator.

16. The method of claim 11 wherein the drilling control input comprises one of rate of drill bit penetration, stand pipe pressure, and combinations thereof.

17. The method of claim 11 wherein the drilling control input comprises rpm.

18. The method of claim 11 wherein the drilling control input comprises fluid flow rate, surface pump pressure and combinations thereof.

19. A system for drilling a wellbore, comprising:

a drilling rig positioned on a surface above the wellbore, the rig having surface sensors operatively connected thereto for collecting surface measurement data;

a drill siring operatively suspended below the rig and into the wellbore, the drill string having a drill bit operatively connected to a downhole end thereof, the drill string having downhole sensors for collecting downhole measurement data operatively connected thereto; and a drilling control system operatively connected to the rig and the drill string, the drilling control system adapted to generate a drilling control model from the measurement data and provide optimized control input for operation of the drill string.

20. The method of claim 19 wherein the surface sensors are capable of measuring one of hook load, block height, stand pipe pressure, torque, rpm, stroke, flow rate and combinations thereof.

21. The method of claim 19, wherein the downhole sensors arc capable of measuring one of weight on bit, internal pressure, annulus pressure, torque, rpm and combinations thereof.

22. The system of claim 19 wherein the drilling control system is capable of determining an optimized drilling control model by comparing the surface measurement data and the downhole measurement data.

23. The system of claim 19, wherein the drilling control system comprises a computer interface/transfer function and a digital switching control regulator.

24. The system of claim 23 wherein the computer interface transfer function is capable or receiving measurement data and providing measurement data output and wherein the digital switching control regulator is capable or receiving the data output and updating the control model in response thereto.

25. The system of claim 19 further comprising a telemetry system for sending signals between the surface and the drill string.

* * * * *